US012180834B2

(12) United States Patent
Chen et al.

(10) Patent No.: US 12,180,834 B2
(45) Date of Patent: Dec. 31, 2024

(54) METHOD FOR SLOPE GEOLOGICAL DISASTER TREATMENT AND MINERAL RESOURCE RECOVERY

(71) Applicant: CHINA UNIVERSITY OF MINING AND TECHNOLOGY, Xuzhou (CN)

(72) Inventors: Shuzhao Chen, Xuzhou (CN); Liu Han, Xuzhou (CN); Cangyan Xiao, Xuzhou (CN); Meng Yang, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 233 days.

(21) Appl. No.: 17/873,970

(22) Filed: Jul. 26, 2022

(65) Prior Publication Data

US 2023/0030467 A1 Feb. 2, 2023

(30) Foreign Application Priority Data

Jul. 27, 2021 (CN) ..... 202110850620.4

(51) Int. Cl.
*E21C 41/26* (2006.01)

(52) U.S. Cl.
CPC ..... *E21C 41/26* (2013.01)

(58) Field of Classification Search
CPC ..... E21C 41/18; E21C 41/26; E21C 41/28; E21F 15/005; E21F 15/00
See application file for complete search history.

(56) References Cited

U.S. PATENT DOCUMENTS

| | | | | |
|---|---|---|---|---|
| 3,892,442 | A * | 7/1975 | Janssen | E21C 41/18 299/11 |
| 2016/0305245 | A1* | 10/2016 | Ma | E21C 41/18 |
| 2016/0326872 | A1* | 11/2016 | Zhao | E21C 41/26 |
| 2017/0248017 | A1* | 8/2017 | MacDonald | E21D 15/00 |
| 2022/0243590 | A1* | 8/2022 | Chen | E21F 15/005 |

FOREIGN PATENT DOCUMENTS

| | | |
|---|---|---|
| CN | 109026006 | * 9/2018 |
| CN | 108894785 | * 11/2018 |
| CN | 111364992 | * 3/2020 |

* cited by examiner

*Primary Examiner* — Carib A Oquendo
(74) *Attorney, Agent, or Firm* — MH2 TECHNOLOGY LAW GROUP LLP

(57) ABSTRACT

A method for slope geological disaster treatment and mineral resource recovery includes the following steps: S1: dividing a mountain top into a plurality of treatment sections and treatment segments; S2, selecting an easy-to-slide area at the upper portion of a first treatment segment and blasting an easy-to-slide body to make the easy-to-slide body roll down to a bottom of the slope; S3, forming a regular initial slope bench; S4, mining coal at the coal seam in a grouped mining adit manner, and laying grouting pipelines in the primary mining adits; S5, forming closed mining adits; S6, excavating secondary mining adits at intervals of the primary mining adits in sequence; S7, continuing mining in an adjacent second treatment segment in the same manner; and S8, continuing mining the first treatment segment of the second treatment section in the same manner.

3 Claims, 3 Drawing Sheets

METHOD FOR SLOPE GEOLOGICAL DISASTER TREATMENT AND MINERAL RESOURCE RECOVERY

CROSS-REFERENCE TO RELATED APPLICATION

This patent application claims the benefit and priority of Chinese Patent Application No. 202110850620.4, filed Jul. 27, 2021, the disclosure of which is incorporated by reference herein in its entirety as part of the present application.

TECHNICAL FIELD

The present disclosure specifically relates to method for slope geological disaster treatment and mineral resource recovery and belongs to the field of mining and environmental treatment.

BACKGROUND ART

In China, there are a large number of mountains distributed in Yunnan, Guizhou, Shanxi and other regions. The towering and steep mountain slopes have potential geological disaster risks such as landslides and mudslides, thus there is an urgent need for identification and treatment of risks of slope. Meanwhile, a large number of coal resources are generally distributed in these mountains. Compared with roof and floor rocks, coal seams are frequently the weak seams inducing the geological disasters, especially multi-seam combined coal seam group which has greater influence. If a traditional blasting treatment mode is employed for the mountains, it means that the coal resource recovery is abandoned, which leads to the influence on the regional economic development. If the coal resources are recovered directly without treatment, there are great safety risks. Therefore, it is necessary to propose a method that combines geological disaster treatment and mineral resource recovery, the resource recovery rate is improved by utilizing the materials recovered by geological disaster treatment, and meanwhile, the slope geological disaster treatment efficiency can be improved by utilizing the benefits of resource recovery.

SUMMARY

For the problems in the prior art described above, an objective of the present disclosure is to provide a method for slope geological disaster treatment and mineral resource recovery to solve problems such as risk of landslide and mining of coal seams at the bottom of an easy-to-slide mountain.

To achieve the objective, the technical solution adopted by the present disclosure is as follows:

A method for slope geological disaster treatment and mineral resource recovery includes the following steps:

S1: dividing a whole mountain top area into a plurality of different treatment sections according to the stability coefficients of easy-to-slide areas at the top of a mountain, wherein each treatment section is further divided into a plurality of treatment segments according to the lengths of spans;

S2: selecting an easy-to-slide area at the upper portion of a first treatment segment in a first treatment section, arranging a plurality of blasting holes disposed vertically and in parallel inside the easy-to-slide area, blasting an easy-to-slide body in a throwing blasting manner to make the easy-to-slide body roll down to the bottom of the slope and piling up the blasted easy-to-slide body that rolls down to the bottom of the slope at the bottom of the mountain to form an artificial presser foot, so as to enhance the stability of the slope of the mountain;

S3: trimming the artificial presser foot to form a regular initial slope bench, keeping the upper surface of the initial slope bench flush with a floor of the lowest coal seam to provide a working platform for subsequent coal resource recovery, wherein when a plurality of coal seams exist at the bottom of the mountain, blasting is desirable to be carried out several times respectively and the height of the working platform is desirable to be piled up to be flush with the height of the corresponding coal seam;

S4 mining coal at the coal seam in a grouped mining adit manner on a working surface of the working platform in the direction toward the coal seam inside the mountain, i.e., excavating rectangular mining adits having a width of 4 m at intervals of 4.5-5 m from one end of the horizontally distributed coal seam, wherein the mining length in the same coal seam is determined according to the slope stability assessment analysis of the influence of the coal seam on the location of the sliding surface and a safety coefficient, with the dip angle of the mining adits being consistent with the dip angle of the coal seam, thus primary mining adits are excavated, and grouting pipelines are laid in the primary mining adit;

S5: after mining of the primary mining adits is finished, filling the primary mining adits with rocks obtained by the blasting of the easy-to-slide body, blocking openings of the primary mining adits by rubber pipes, injecting cement paste into the primary mining adits through the grouting pipelines to cement the filling materials into a whole and to achieve wind resistance and water plugging, thus forming closed mining adits;

S6: sequentially excavating secondary mining adits at the intervals between the primary mining adits, with one secondary mining adit between every two primary mining adits, continuing coal mining, filling with rocks, and injection of paste and cementing in the secondary mining adits in the same manner as in the primary mining adits;

S7: after the coal seams in the first treatment segment of the first treatment section are all mined, continuing mining in an adjacent second treatment segment in the same manner as in the first treatment segment; and

S8: after the mining of the first treatment section is finished, blasting an easy-to-slide body at the top of the mountain of an adjacent second treatment section, wherein crushed materials fall to the bottom of the mountain to be piled up to a sub-lowest coal seam with a higher horizontal position to form a new working platform, and continuing mining in a first treatment segment of the second treatment section on a working surface of the new working platform in the same manner as in the first treatment segment of the first treatment section.

Preferably, the span of each segment can range from 50 to 200 min the step S1.

Preferably, the initial slope bench can have a height of 10 to 15 m, the angle of bench slope can be not greater than 25°, and the working platform can have a width of not less than 50 min the step S3.

The present disclosure has the beneficial effects that:

(1) Easy-to-slide bodies at the upper portion of the slope are removed, materials are used as the slope presser feet and used to fill the mining adits formed after resource recovery, such that the crushed rocks left after blasting are effectively treated, the resources in the slope are recovered by means of the working surface formed by cleaning the bottom of the slope and backfilling the materials, thus weak seams in the slope is removed.

(2) The materials with high strength and stability in the obtained slope rock materials are preferentially removed to fill in the mining adits, then the mining adits are subjected to injection of paste and cementing, thus the strength and integrity of the slope rock are improved.

Figure 1:
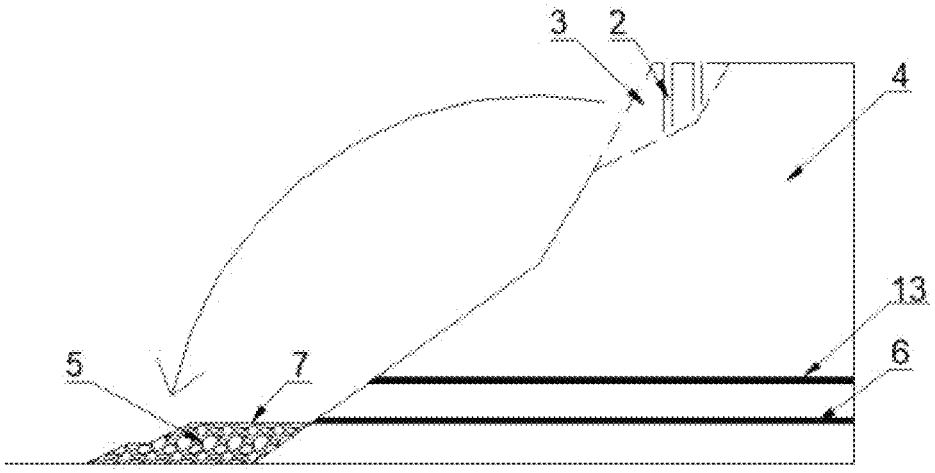
FIG. 1 is a side view of a construction scheme.

In the drawings: 1—first treatment section; 1-1—first treatment segment; 2—blasting hole; 3—easy-to-slide body; 4—mountain; 5—initial slope bench; 6—lowest coal seam; 7—working platform; 8—mining adit; 8-1—primary mining adit; 8-2—secondary mining adit; 9—false roof; 10—false bottom; 11—grouting pipeline; 12—second treatment section; 12-1—first treatment segment of second treatment section; 13—sub-lowest coal seam.

DETAILED DESCRIPTION OF THE EMBODIMENTS

The present disclosure is further described in detail below with reference to the accompanying drawings.

Figure 2:
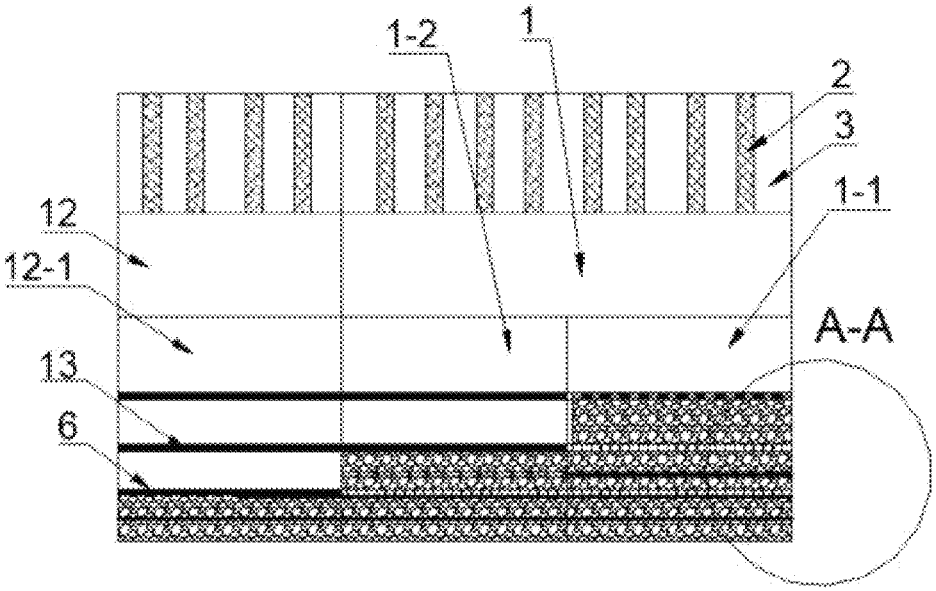
FIG. 2 is a front view of a construction scheme.

A method for slope geological disaster treatment and mineral resource recovery comprises the following steps as shown in FIG. 1 and FIG. 2:

S1: dividing a whole mountain top area into a plurality of different treatment sections according to the stability coefficients of easy-to-slide areas at the top of a mountain 4, wherein each treatment section is further divided into a plurality of treatment segments according to the lengths of spans. Normally, the span of each segment ranges from 50 to 200 m, the range is more reasonable for the setting of the mining work of the same coal seam, wherein it is not conducive to the complete coal seam mining if the range is too small, and the division of the treatment sections may be unreasonable if the range is too large which results in excessive blasting in the easy-to-slide areas and bringing more workload for the later work.

S2: selecting an easy-to-slide area at the upper portion of a first treatment segment 1-1 in a first treatment interval 1, arranging a plurality of blasting holes 2 disposed vertically and in parallel inside the easy-to-slide area. blasting an easy-to-slide body 3 in a throwing blasting manner to make the easy-to-slide body roll down to the bottom of the slope and piling up the blasted easy-to-slide body that rolls down to the bottom of the slope at the bottom of the mountain to form an artificial presser foot, so as to enhance the stability of the slope of the mountain 4.

S3: trimming the artificial presser foot to form a regular initial slope bench 5, keeping the upper surface of the initial slope bench 5 flush with a floor of the lowest coal seam 6 to provide a working platform 7 for subsequent coal resource recovery, wherein when a plurality of coal seams exist at the bottom of the mountain, blasting is desirable to be carried out several times respectively and the height of the working platform 7 is desirable to be piled up to be flush with the height of the corresponding coal seam. As a preferred scheme, in order to improve the safety of the working platform 7 and make the construction of excavation equipment more convenient, the initial slope bench 5 has a height of 10 to 15 m, the angle of bench slope is not greater than 25°, and the working platform 7 has a width of not less than 50 m.

Figure 3:
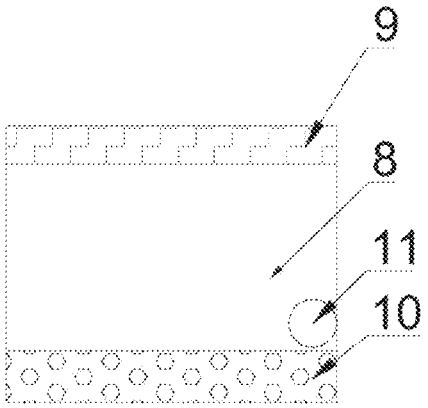
FIG. 3 is a cross-section view of a mining adit.

S4 mining coal at the coal seam in a grouped mining adit manner on a working surface of the working platform 7 in the direction toward the coal seam inside the mountain 4: excavating rectangular mining adits having a width of 4 m at intervals of 4.5-5 m from one end of the horizontally distributed coal seam, wherein the mining length in the same coal seam is determined according to the slope stability assessment analysis of the influence of the coal seam on the location of the sliding surface and a safety coefficient, with a dip angle of the mining adits being consistent with the dip angle of the coal seam, thus primary mining adits 8-1 are excavated, and grouting pipelines 11 are laid in the primary mining adits 8-1. When the thickness of the coal seam is less than 4 m, the height of the mining adits is equal to the sum of the thicknesses of the coal seam, the false roof 9 and the false bottom 10; and when the thickness of the coal seam is greater than 4 m, the coal seam is divided into a plurality of sub-coal seams with thicknesses less than 3 to 4 m to be mined seam by seam from bottom to top, as shown in FIG. 3.

S5: after mining of the primary mining adits 8-1 is finished, filling the primary mining adits 8-1 with rocks obtained by the blasting of the easy-to-slide body 3, blocking openings of the primary mining adits by rubber pipes, injecting cement paste into the primary mining adits 8-1 through the grouting pipelines 11 to cement the filling materials into a whole and to achieve wind resistance and water plugging, thus forming closed mining adits.

S6: sequentially excavating secondary mining adits at the intervals between the primary mining adits 8-1, with one secondary mining adit 8-2 between every two adjacent primary mining adits 8-1, continuing coal mining, filling with rocks, and injection of paste and cementing in the secondary mining adits in the same manner as in the primary mining adits.

Figure 4:
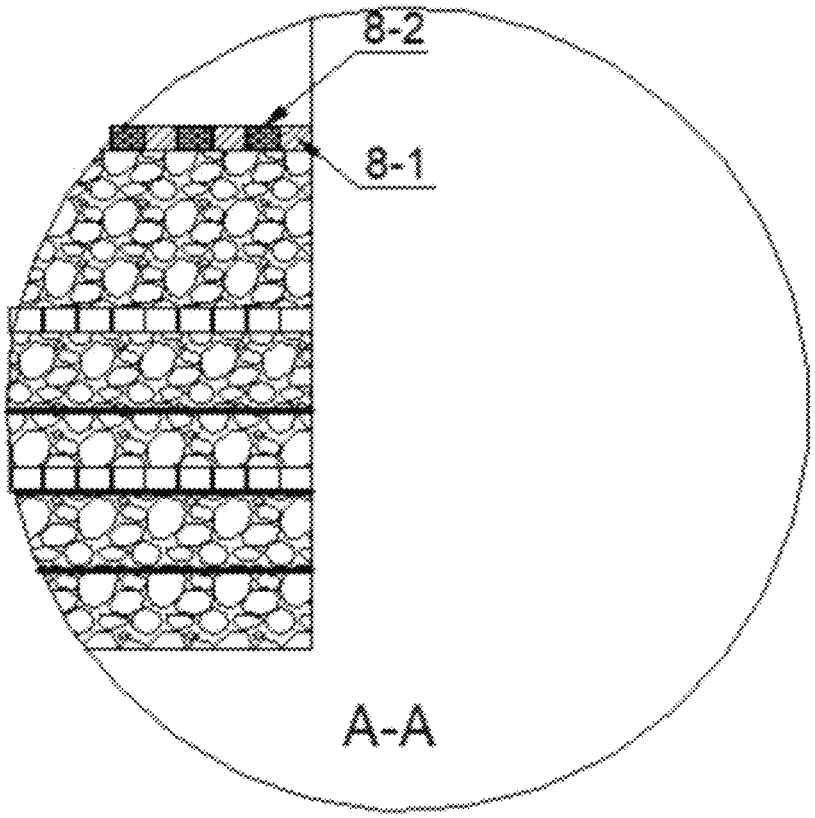
FIG. 4 is a structural schematic view of primary mining adits and secondary mining adits partially enlarged at A-A of FIG. 2.

S7: after the coal seams in the first treatment segment 1-1 of the first treatment section 1 are all mined, continuing mining of an adjacent second treatment segment in the same manner as in the first treatment segment, as shown in FIG. 4.

Figure 5:
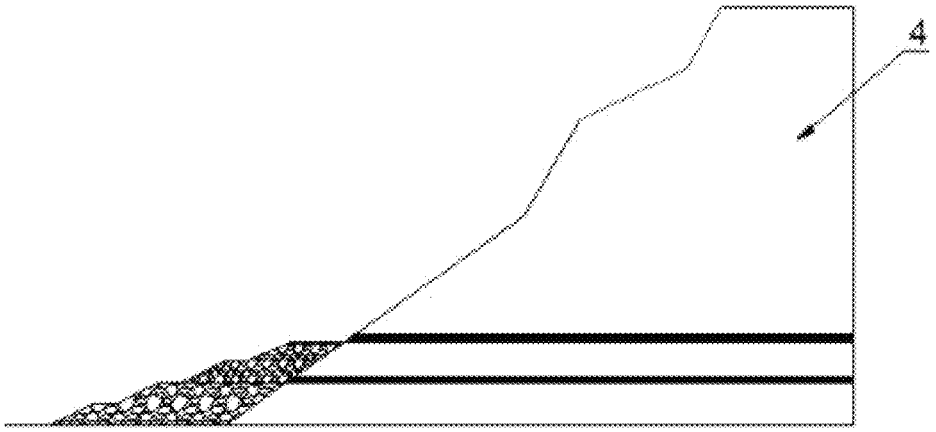
FIG. 5 is a structural schematic view of a new working platform formed at a sub-lowest coal seam.

S8: after the mining of the first treatment section 1 is finished, blasting an easy-to-slide body 3 at the top of the mountain of the adjacent second treatment section 12, wherein crushed materials fall to the bottom of the mountain, to be piled up to the sub-lowest coal seam 13 with a higher horizontal position to form a new working platform 7, and continuing mining in a first treatment segment 12-1 of the second treatment section on a working surface of the new working platform in the same manner as in the first treatment segment of the first treatment section, as shown in FIG. 5.

In accordance with the resource recovery method provided by the present disclosure, the easy-to-slide body 3 at the top of the mountain is actively blasted, the easy-to-slide body 3 is crushed and then rolls down to the bottom of the mountain to be piled up as the initial slope bench 5, thus the working plane is formed; then the excavation equipment is conveyed to the working surface to mine the coal seams in the mountain 4, the coal seams are mined in a manner of firstly mining the primary mining adits 8-1 at intervals and then mining the secondary mining adits 8-2 at the interval of two adjacent primary mining adits after sealing and reinforcing the primary mining adits, and coal pillars also exist between the primary mining adits 8-1 and the secondary mining adits 8-2 to protect the structure stability of the whole mountain 4. In accordance with the method, problem of hidden geological risks of landslide of the mountain 4 is solved, and coal resources in such mountain 4 are also effectively mined, thus the economic benefits are increased while environmental protection benefits are obtained.

What is claimed is:

1. A method for slope geological disaster treatment and mineral resource recovery, comprising the following steps:

S1: dividing a whole mountain top area into a plurality of different treatment sections according to stability coefficients of easy-to-slide areas at top of a mountain (4), wherein each treatment section is further divided into a plurality of treatment segments according to lengths of spans;

S2: selecting an easy-to-slide area at an upper portion of a first treatment segment (1-1) in a first treatment section (1), arranging a plurality of blasting holes (2) disposed vertically and in parallel inside the easy-to-slide area, blasting an easy-to-slide body (3) in a throwing blasting manner to make the easy-to-slide body roll down to a bottom of a slope and piling up the blasted easy-to-slide body that rolls down to the bottom of the slope at bottom of the mountain to form an artificial presser foot, so as to enhance stability of the slope of the mountain (4);

S3: trimming the artificial presser foot to form a regular initial slope bench (5), keeping an upper surface of the initial slope bench (5) flush with a floor of a lowest coal seam (6) to provide a working platform (7) for subsequent coal resource recovery, wherein when a plurality of coal seams exist at the bottom of the mountain, blasting is desirable to be carried out several times respectively and a height of the working platform (7) is desirable to be piled up to be flush with a height of a corresponding coal seam of the plurality of coal seams;

S4: mining coal at the coal seam in a grouped mining adit manner on a working surface of the working platform (7) in a direction toward the coal seam inside the mountain (4): excavating rectangular mining adits having a width of 4 m at intervals of 4.5-5 m from one end of the coal seam that is horizontally distributed, wherein a mining length in the same coal seam is determined according to slope stability assessment analysis of influence of the coal seam on location of a sliding surface and a safety coefficient, with a dip angle of the mining adits being consistent with a dip angle of the coal seam, thus primary mining adits (8-1) are excavated, and grouting pipelines (11) are laid in the primary mining adits (8-1);

S5: after mining of the primary mining adits (8-1) is finished, filling the primary mining adits (8-1) with rocks obtained by blasting of the easy-to-slide body (3), blocking openings of the primary mining adits by rubber pipes, injecting cement paste into the primary mining adits (8-1) through the grouting pipelines (11) to cement filling materials into a whole and to achieve wind resistance and water plugging, thus forming closed mining adits;

S6: sequentially excavating secondary mining adits (8-2) at the intervals between the primary mining adits (8-1), with one secondary mining adit (8-2) between every two adjacent primary mining adits (8-1), continuing coal mining, filling with rocks, and injection of paste and cementing in the secondary mining adits in the same manner as in the primary mining adits;

S7: after the coal seams in the first treatment segment (1-1) of the first treatment section (1) are all mined, continuing mining in an adjacent second treatment segment in the same manner as in the first treatment segment; and S8: after mining of the first treatment section (1) is finished, blasting an easy-to-slide body (3) at atop of the mountain of an adjacent second treatment section (12), wherein crushed materials fall to the bottom of the mountain to be piled up to a sub-lowest coal seam (13) with a higher horizontal position to form a new working platform (7), and continuing mining in a first treatment segment (12-1) of the second treatment section on a working surface of the new working platform in the same manner as in the first treatment segment of the first treatment section.

2. The method for slope geological disaster treatment and mineral resource recovery according to claim 1, wherein in the step S1, the span of each segment ranges from 50 to 200 m.

3. The method for slope geological disaster treatment and mineral resource recovery according to claim 1, wherein in the step S3, the initial slope bench (5) has a height of 10 to 15 m, an angle of bench slope is not greater than 25°, and the working platform (7) has a width of not less than 50 m.

* * * * *